US006180934B1

(12) United States Patent
Ishizaki et al.

(10) Patent No.: US 6,180,934 B1
(45) **Date of Patent: *Jan. 30, 2001**

(54) COOKING APPARATUS HAVING MEANS FOR STORING AND DISPLAYING COOKING RECIPES

(75) Inventors: Emiko Ishizaki, Mie; Noboru Okui, Nara, both of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/983,508

(22) PCT Filed: Jul. 29, 1996

(86) PCT No.: PCT/JP96/02126

§ 371 Date: Jan. 27, 1998

§ 102(e) Date: Jan. 27, 1998

(87) PCT Pub. No.: WO97/05430

PCT Pub. Date: Feb. 13, 1997

(30) Foreign Application Priority Data

Jul. 28, 1995 (JP) ..... 7-193041

(51) Int. Cl.[7] ..... H05B 6/68

(52) U.S. Cl. ..... 219/720; 219/702; 219/506; 99/325

(58) Field of Search ..... 219/720, 702, 219/715, 506, 714, 719; 99/325

(56) References Cited

U.S. PATENT DOCUMENTS

| | | | | |
|---|---|---|---|---|
| 4,517,429 | * | 5/1985 | Horinouchi | 219/720 |
| 4,725,948 | * | 2/1988 | Mierzwinski | 219/720 |
| 4,933,527 | * | 6/1990 | Edamura | 219/506 |
| 5,183,984 | * | 2/1993 | Nakagawa | 219/506 |
| 5,221,817 | * | 6/1993 | Ota | 219/720 |
| 5,317,134 | * | 5/1994 | Edumura | 219/720 |
| 5,321,232 | * | 6/1994 | Ogle | 219/506 |

FOREIGN PATENT DOCUMENTS

| | | |
|---|---|---|
| 0 075 026 | 3/1983 | (EP) . |
| 0 454 143 A2 | 10/1991 | (EP) . |
| 62-26421 | 2/1987 | (JP) . |
| 63-129106 | 8/1988 | (JP) . |
| 3-87518 | 4/1991 | (JP) . |
| 5-187641 | 7/1993 | (JP) . |
| 5-187642 | 7/1993 | (JP) . |
| 5-332562 | 12/1993 | (JP) . |

* cited by examiner

*Primary Examiner*—Philip H. Leung
(74) *Attorney, Agent, or Firm*—McDermott, Will & Emery

(57) ABSTRACT

To present a heating cooker that is easy to use, not requiring cook book or instruction manual, and its operating method, relating to a heating cooker for displaying the cooking procedure, types of materials, amount of materials, heating method, heating time, etc. The constitution comprises cooking setting keys for selecting the cooking method for cooking the materials, cooking time setting keys for entering the cooking time, cooking selection keys for selecting the kind of cooking such as delicatessen as mentioned in the cook book, memory for storing the materials necessary for cooking, amount, cooking tools, all cooking methods and required time, display apparatus for displaying the cooking menu, cooking time, preparation method and cooking method, and operating method of heating cooker when cooking, and control device for controlling by identifying the necessary information for each cooking selected by the cooking selection key and showing in the display apparatus.

12 Claims, 4 Drawing Sheets

COOKING APPARATUS HAVING MEANS FOR STORING AND DISPLAYING COOKING RECIPES

TECHNICAL FIELD

The present invention relates to a heating cooker, and more particularly to a heater cooker comprising a microcomputer and its operating method.

BACKGROUND ART

Heating cookers are recently installed in almost all households, and appear to be used fully at home. Owing to the progress in sensor technology, automation of cooking is promoted, and it was believed that easy-to-use heating cookers be presented. Actually, however, the cooking is prepared by looking up in the cook book, and the preparation is over, the user must check up the instruction manual of the heating cooker to understand the method of operation, and cook by the heating cooker. In particular, the high frequency heating cooker such as microwave oven is rarely used in preparation of so-called delicatessen, and is used only for "heating" purpose. When cooking a traditional menu by the microwave oven, the cooking method by the microwave oven is not known, and the user must look up in the cook book. It results in botheration. Besides, kinds of dishes that can be cooked by the microwave oven are not known to the public. It is hence necessary to inform the user of the kinds of dishes that can be cooked by the microwave oven.

The operating method of the microwave oven is dramatically simplified thanks to the user of the barcode and the like. Therefore, those who are familiar with the microwave oven can use the microwave oven without referring the instruction manual. However, most people used to cook by looking up in the cook book to know the kind of materials, amount of materials, and kind of dishes. That is, the user has decided the cooking method and cooking time using the microwave oven by experience or by consulting the cook book. Further, when the method of operation of the microwave oven is not known, the user generally operated by referring to the instruction manual. Even in such a case, the user needs a considerable skill, and most users are not utilizing the microwave oven to the full.

To solve such problems, automated heating cookers having multiple sensors are proposed. That is, the user has only to select the cooking menu, and can cook. In this case, the user need not know the cooking method or cooking time. Even in such automated heating cooker, the user must refer to the instruction manual to know the operating method. Moreover, as for the materials to be prepared, amount of materials, and method of preparation, most users must consult the cook book. Therefore, while looking at the cook book during preparation of materials, the cook book may be soiled and stained.

On the other hand, for the purpose of facilitating the operation of the heating cooker, the barcode is used. That is, by the input of cooking menu and cooking time through the barcode, a uniform operation is realized, and the heating cooker that can be used without looking up in the instruction manual is presented. Even in such barcode type heating cooker, however, the user must consult the cook book to know the materials to be prepared, amount of materials, and method of preparation. Therefore, due to the trouble of looking up in the cook book, only few users can utilize the heating cooker to the full. Besides, while the heating cooker is used for many years, the accompanying cook book is used up earlier. In the barcode type, the device for reading the barcode may be soiled, or the barcode may be lost.

Summing up, the following problems must be solved in the conventional heating cooker that requires the cook book and instruction manual.

(1) The greater the number of dishes to be cooked, the more difficult is the setting of cooking method and cooking time depending on the experience. If attempted to cook without consulting the cook book or instruction manual, it is likely to set wrong cooking method or time, which involves a risk of resulting in failure in cooking. On the other hand, when cooking while consulting the cook book and instruction manual, it is very bothersome to look up all of cooking procedure and operating method of heating cooker. Besides, the book may be stained, or the cooking may be done by the hands holding the book, and it may be unclean.

(2) If cooking is done automatically by using the sensor, all process of cooking including preparation cannot be done automatically. If all cooking may be done automatically, it is extremely difficult for the user to complete one dish by combination of plural cooking menus out of numerous automatic menus. The cooker which can cook automatically does not prepare the materials and necessary amounts automatically. On every occasion of cooking, the user must look up in the cook book. Therefore, if the heating cooker can be used for many years, the cook book may be damaged or lost on the way. As a result, cooking may not be done.

(3) In the heating cooker using the barcode, the cook book is indispensable, and the use of the barcode and cook book is very bothersome for the user.

DISCLOSURE OF THE INVENTION

In the light of the above background, it is an object of the invention to present a heating cooker that can be used easily by any user without having to look up in the cook book or instruction manual, and its operating method.

The heating cooker of the invention comprises heating means for heating materials, memory means storing plural pieces of information, plural input means for feeding a desired one out of the plural pieces of information, display means for displaying at least one of the plural pieces of information, and control means for conducting plural controls including identification of the plural pieces of information, instruction of operation, instruction of display, and instruction of heating.

The control means identifies the desired information entered by one of the plural input means out of the plural pieces of information stored in the memory means, and simultaneously transmits information for urging next execution to the user to the display means.

The display means displays the desired information, and simultaneously displays the information for urging next execution to the user.

The input operation and display are repeated by a specific number of times.

Finally, the heating means executes heating when the user manipulates other input means out of the plural input means according to the information urging next execution to the user.

In this constitution, cooking can be completed by preparation and operation according to the instruction shown on the display means. Therefore, it is not necessary to refer to the cook book or instruction manual of the heating cooker. As a result, the heating cooker that can be used easily and simply can be presented.

In particular, preferably, the heating means is high frequency electric power.

Preferably, the plural input means include cooking selection keys for setting the cooking menu.

Preferably, the plural input means include cooking setting keys for setting the cooking method.

Preferably, the plural input means include cooking time keys for setting the cooking time.

Preferably, the plural input means include a forward key, and by the manipulation of the forward key, the information urging next execution to the user is displayed in the display means.

In particular, the number of characters displayed on one screen of the display means is a limited and specified number, and when the number of characters in the one piece of information displayed in the display means is more than the limited and specified number, the one piece of information is displayed continuously in the display means in a flowing manner.

Moreover, preferably, the plural input means include a pause/restart key, and by manipulation of the pause/restart key, the flowing display of the one piece of information is stopped temporarily, and by further manipulation of the pause/restart key, the stopped information is displayed in a flowing manner.

Preferably, he plural input means include a return key, and by manipulation of the return key, the information displayed before the information being displayed at the present can be displayed again in the display means.

Preferably, the other input means is a start key.

In this constitution, the above effects are further intensified.

An operating method of a heating cooker of the invention comprises the following steps.

(a) A step of using a heating cooker comprising heating means for heating materials, memory means storing plural pieces of information, plural input means for feeding a desired one out of the plural pieces of information, display means for displaying at least one of the plural pieces of information, and control means for conducting plural controls including identification of the plural pieces of information, instruction of operation, instruction of display, and instruction of heating.

(b) A step of manipulating first input means out of the plural input means. At this time, by manipulation of the first input means at this time, desired first information out of the plural pieces of information stored in the memory means, and second information urging next execution to the user are displayed in the display means.

(c) A step of manipulating second input means out of the plural input means according to the second information urging next execution to the user. At this time, third information and fourth information urging next execution to the user out of the plural pieces of information stored in the memory means are displayed in the display means.

(d) A step of manipulating third input means out of the plural input means, according to the fourth information urging next execution to the user. At this time, heating is executed by the heating means.

In this constitution, cooking can be completed by preparation and operation according to the instruction shown on the display means. Therefore, it is not necessary to refer to the cook book or instruction manual of the heating cooker. As a result, the user can cook by using the heating cooker easily and simply.

BEST MODE OF CARRYING OUT THE INVENTION

Figure 3:
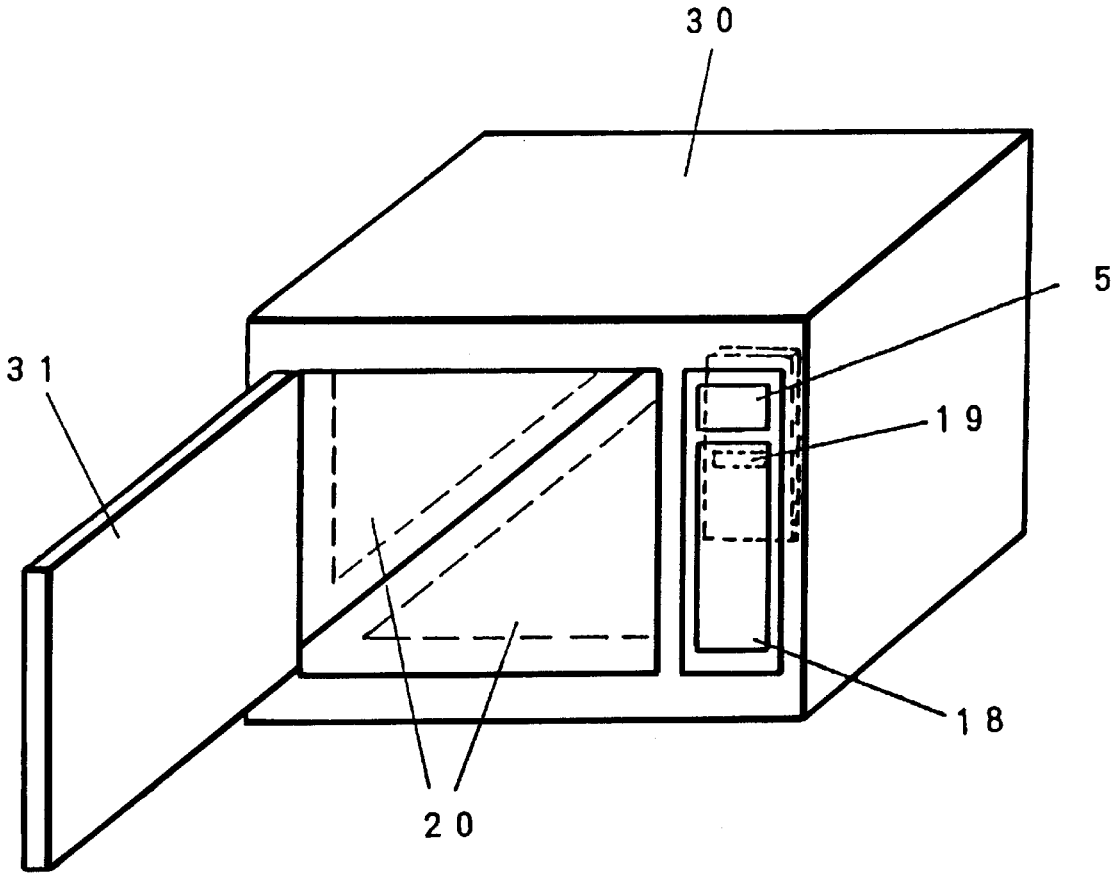
FIG. 3 is a perspective view of a main body of a heating cooker in an embodiment of the invention.

An embodiment of a heating cooker of the invention is described below. FIG. 3 is a perspective view of a heating cooker in an embodiment of the invention. In FIG. 3, a door 31 is installed at the front side of a main body 30 of a heating cooker, and an operation unit 18 is installed beside the door 31. Display means 5 is disposed at the upper side of the operation unit 18. At the rear side of the operation unit 18, control means 19 is disposed. Memory means 21 is electrically connected to the control means 19. A heating source 20 is installed in at least one position of the upper, lower or lateral side of a main body 3. The heating source 20 is not particularly limited, but, for example, high frequency power, resistance type heater, or far infrared ray may be used. The memory means 21 includes a microcomputer function, and stores plural pieces of information including plural cooking menus, materials necessary for cooking them, amount of materials, cooking tools, all cooking methods to be employed, cooking time, operating procedure, heating instruction, and display instruction. The operation unit 18 includes plural input means for manipulating. The display means 5 shows, for example, the cooking menu, cooking time, preparation and cooking procedure, and operating method of the heating cooker. The control means 19 identifies the information to be shown in the display means 5, or executes heating, according to the input to the operation unit 18.

Figure 4:
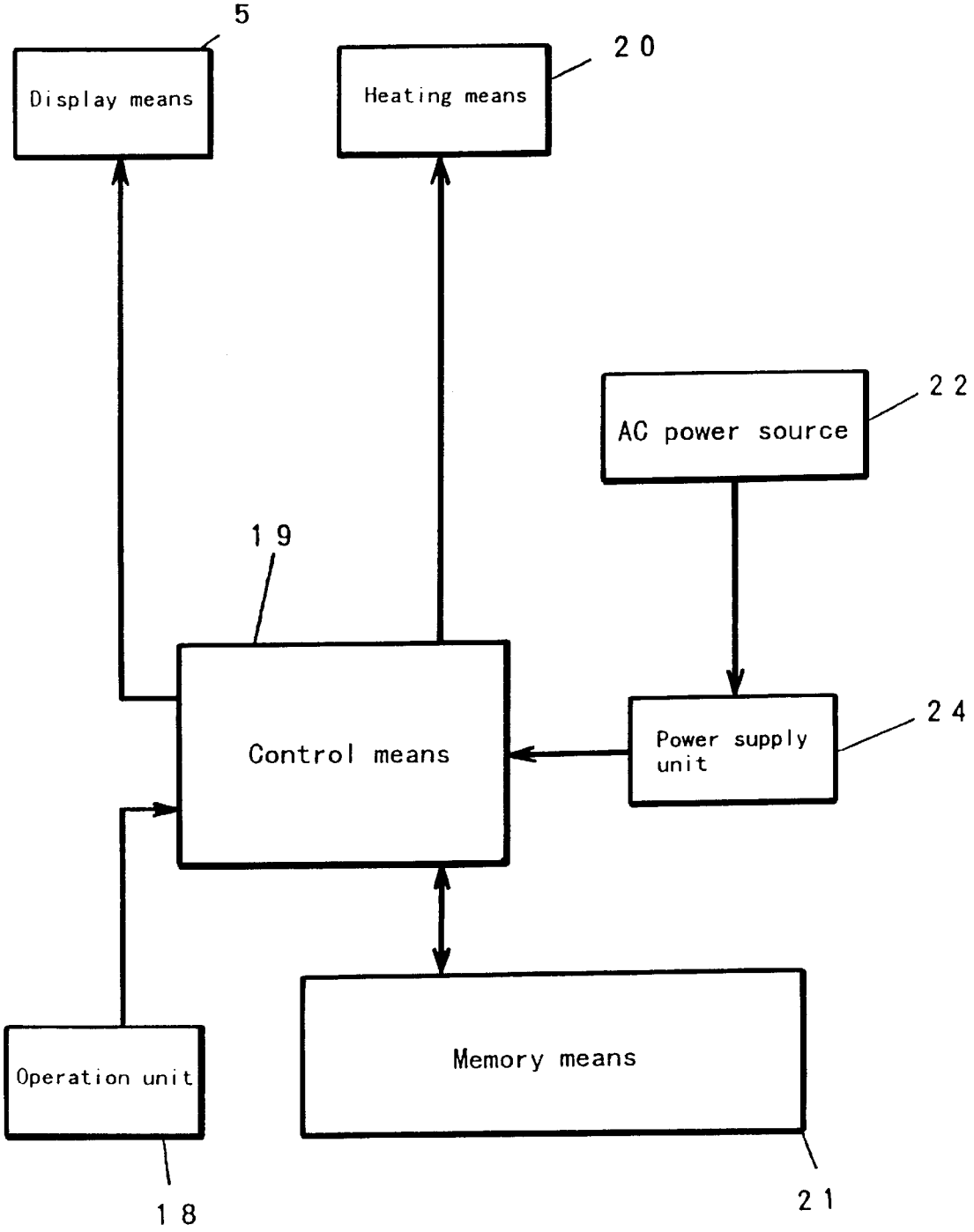
FIG. 4 is a block diagram of a system of a heating cooker in an embodiment of the invention.

FIG. 4 is a block diagram of a heating cooker according to an embodiment of the invention. In FIG. 4, the control means 19 sends the information showing, for example, what kind of heating to be executed to the heating unit 20 on the basis of the input means of the operation unit 18. The control means 19 further searches and selects the display data of the cooking guide stored in the memory means 21 according to the input means of the operation unit 18, and sends the information showing, for example, what display is to be shown to the display unit 5. That is, the control means identifies the desired information entered in one input means out of plural input means of the operation unit 18 from plural pieces of information stored in the memory means 21, and transmits the information to be executed next by the user to the display means 5. The display means 5, on the basis of the information from the memory means 21 and control means 19, displays the necessary information. The control means 19 is connected to an AC power source 22 through a power supply unit 24.

Figure 1:
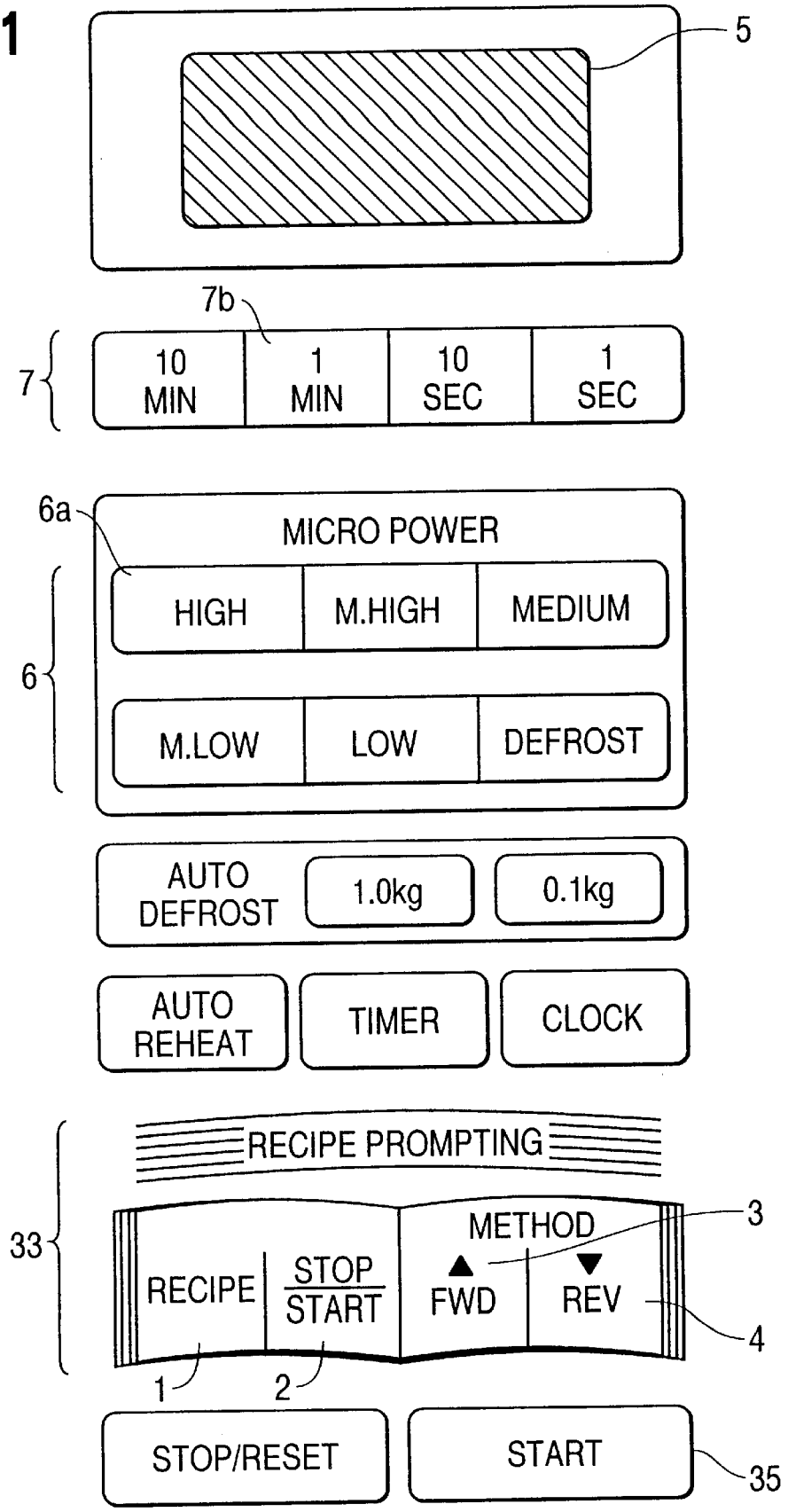
FIG. 1 is an explanatory diagram of a control panel of a heating cooker in an embodiment of the invention.

FIG. 1 is an explanatory diagram of a control panel of an embodiment of the operation unit 18 shown in FIG. 3. In FIG. 1, desired information is shown in the display means 5. However, the number of characters shown in the display means 5 is limited. Therefore, all of desired information is not displayed simultaneously in the display means 5. If there are many characters to be displayed, the characters are displayed on the screen in a flowing manner. In the lower part of the control panel, plural keys of guide function 33 are provided. The Recipe key is a cooking selection key 1 for selecting the type of cooking. Types of cooking include, for example, delicatessen, cookie, curry, stew, and other cooking menus. Such cooking menus are preliminarily stored in the memory means 21. The Stop/Start key is a display pause/restart key 2 for stopping the desired display or feeding to next display. The FWD key is a forward key 3 for advancing the guide display of a group of cooking procedure to the guide display of next group of procedure. The REV key is a return key 4 for returning the shown guide display to the previous display.

At the lower side of the display means 5, cooking time setting keys 7 having plural keys are disposed. The cooking time setting keys 7 control the cooking time. At the lower side of the cooking time setting keys 7, there are cooking setting keys 6 having plural keys. The cooking setting keys 6 control the application power of the heating means 20.

Incidentally, the characters shown in the display means 5 are displayed in a flowing manner, but alternatively, it may be also designed to display the desired display by dividing into plural screens by screen changeover operation.

Figure 2:
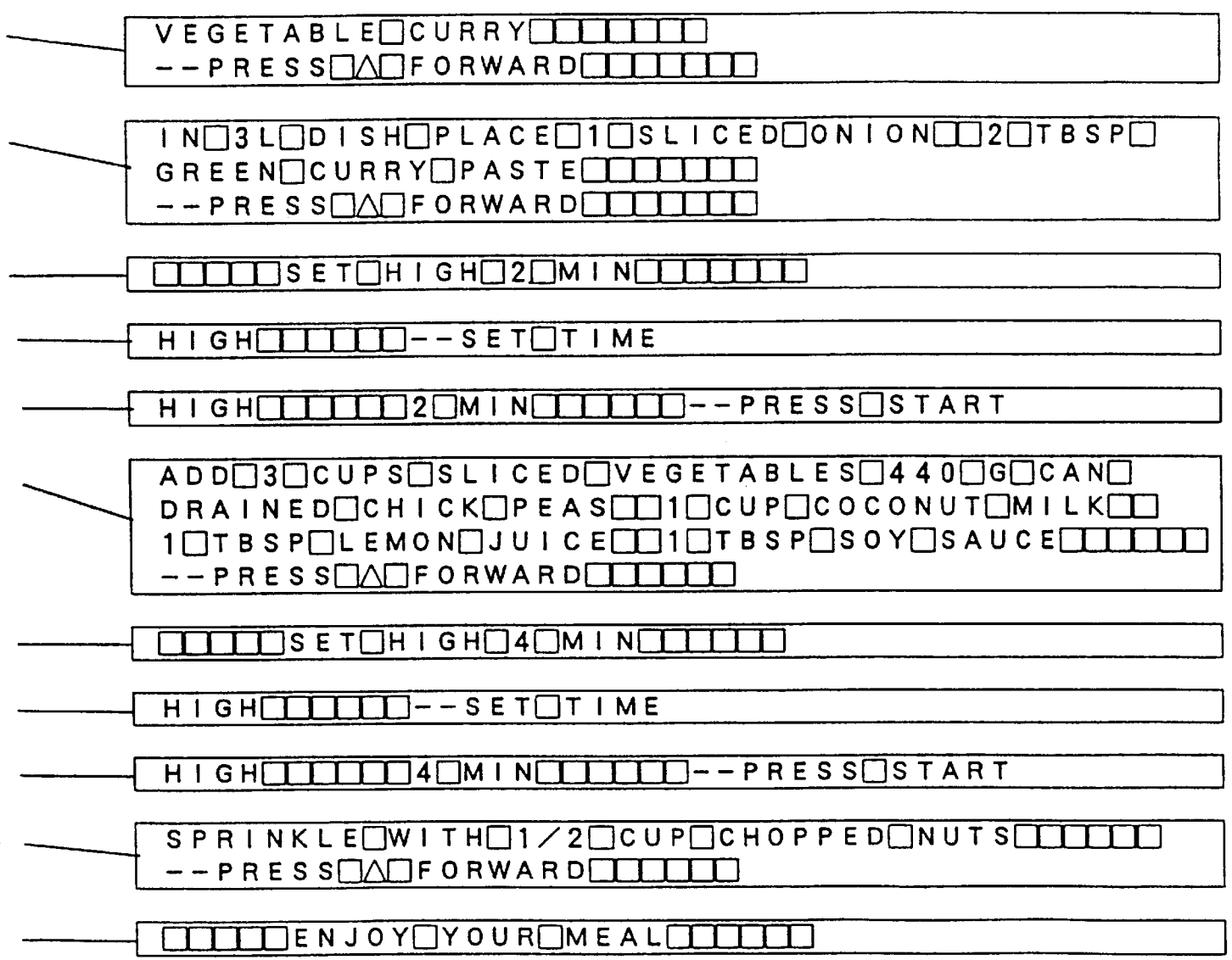
FIG. 2 is an example of a guide display shown in display means of heating cooker of the invention.

The action and operating method of the heating cooker of the invention are described below by referring to FIG. 1 and FIG. 2. An embodiment of the display data displayed in the display means 5 is shown in FIG. 2.

(1) First, by pressing the cooking selection key 1, one menu out of plural cooking menus is selected. For example, when the selected menu is the vegetable curry, as shown in the first display in FIG. 2, the selected menu name "VEGETABLE□CURRY□□□□□□□" and the key input urging display for moving forward"—PRESS□Δ□FORWARD□□□□□□" are shown. In FIG. 2, meanwhile, "□" means a space and "Δ" denotes FWD key.

(2) Next, press the forward key 3. Consequently, as in the second display 10 in FIG. 2, the item to be prepared is displayed. That is, it instructs "Put 1 onion, sliced, and 2 spoonfuls of green curry paste in a 3 L size dish," and "Press forward key 3 when ready."

(3) When the materials are ready, press forward key 3. As a result, the third display 11 tells "Cook for 2 minutes in high power."

(4) Accordingly, by pressing the High key 6*a* of the cooking setting keys 6, the high power is set. As a result, the fourth display 16 appears. The fourth display 16 urges to "Enter cooking time."

(5) The press the 1 Min key 7*b* twice out of the cooking time setting keys 7. As a result, the cooking time of 2 minutes is set. Then the fifth display 17 appears. The fifth display 17 urges to "Press cooking start key."

(6) Then press the start key 35. As a result, cooking starts, and cooking is finished in 2 minutes. When the cooking is over, the sixth display 12 appears. The sixth display tells what to do next. That is, the sixth display 12 instructs to "Add 3 cups of sliced vegetable, 440 grams of dried peas, 1 cup of coconut milk, 1 spoonful of lemon juice, and 1 spoonful of soy sauce." It also urges to "Press forward key" when ready.

(7) When the materials are prepared, press the forward key 3. As a result, the seventh display 13 appears. The seven display 13 tells to "Cook for 4 minutes in high power."

(8) By pressing the High key 6*a* of the cooking setting keys 6, the high power is set. As a result, the eighth display 36 appears. The eighth display urges to "Enter cooking time."

(9) The press the 1 Min key 7*b* four times out of the cooking time setting keys 7. As a result, the cooking time of 4 minutes is set. Then the ninth display 37 appears. The ninth display 37 urges to "Press cooking start key."

(10) Then press the start key 35. As a result, cooking starts, and cooking is finished in 4 minutes. When the cooking is over, the tenth display 14 appears. The tenth display 14 instructs to "Sprinkle is ½ cup of crushed nuts" and "After that, press forward key."

(11) When the materials are prepared, press the forward key 3. As a result, the eleventh display 15 appears. The eleven display 15 means "Cooking is over" and tells "ENJOY YOUR MEAL."

By this operation and procedure, the cooking is finished.

As described herein, the user has only to manipulate to select the desired cooking menu, and prepare materials and execute operation of heating means according to the instruction shown in the display means. That is, without referring to the guide book of cooking or instruction manual of the heating cooker, the procedure from preparation till completion of cooking can be understood. Therefore, even an inexperienced person can cook easily by using the heating cooker.

INDUSTRIAL APPLICABILITY

As described herein, the following effects are brought about by the heating cooker of the invention.

(1) It is possible to cook without referring to the cook book or guide book of cooking or the instruction manual of the heating cooker. That is, the cooking can be completed by the preparation and operation according to the instruction shown in the display means. Therefore, even an inexperienced person can cook easily and simply.

(2) It is not necessary to read the cook book or instruction manual stained by cooking materials. Hence, clean cooking is realized.

(3) Since the memory means has the function of microcomputer, and includes cooking guides for numeral types of cooking, anyone can prepare complicated cooking easily.

(4) It eliminates the trouble of "consulting the cook book, guide book of cooking, or instruction manual of heating cooker."

(5) A simple and convenient heating cooker that can be used by an inexperienced person can be presented.

What is claimed is:

1. A heating apparatus comprising:

cooking selection keys for selecting a cooking recipe, memory means for storing information necessary for said cooking recipe, control means for controlling by identifying and displaying on a display means the information necessary for each cooking recipe selected by said cooking selection key, said information having at least one selected from the group consisting of materials necessary for cooking, amount of the materials, preparation methods, heating methods and treating methods after heating, input means for entering selectively a plurality of inputs to be input by a user according to instructions displayed on said display means, and heating means for heating by selection input operation of said input means, said heating means including high frequency electric power, wherein after each of a plurality of steps the user inputs and executes according to the information displayed on the display means, each instruction for urging next execution to said user is displayed on said display means, then said user inputs and executes according to said each instruction, and said cooking is finished through said each step.

2. A heating apparatus of claim 1, wherein said plurality of input means include a cooking setting key for setting a cooking method.

3. A heating apparatus of claim 1, wherein said plurality of input means include a cooking time key for setting a cooking time.

4. A heating apparatus of claim 1, wherein said input means comprises a start key for setting a cooking start.

5. The heating apparatus of claim 1, wherein said display means displays the information for cooking using the heating means and the information for preparing the material without using the heating means, when the user inputs said input means according to said information, the cooking is executed, and the user prepares the material without using the heating means according to said information.

6. A heating apparatus comprising:

a cooking selection key for selecting one of a plurality of cooking names, memory means for storing a plurality of pieces of information including said plurality of cooking names, a plurality of cooking methods, a plurality of cooking times and a plurality of operating methods, wherein said plurality of cooking methods include at least one selected from the group consisting of materials necessary for cooking, amount of the materials, preparation methods and heating methods, a cooking setting key for setting one cooking method out of said plurality of cooking methods, heating means for heating an object to be cooked, said heating means including high frequency electric power, a cooking time setting key for setting one cooking time out of said plurality of cooking times, display means for displaying at least one piece of information out of said plurality of pieces of information, and control means for making a plurality of controls including identification of said plurality of pieces of information, instructions for operation, instructions for display, and instructions for heating, wherein an information for urging a user to execute next action out of said plurality of pieces of information is displayed in said display means by an action of said control means.

7. The heating apparatus of claim 6, wherein said display means displays the information for cooking using the heating means and the information for preparing the material without using the heating means, when the user inputs said input means according to said information, the cooking is executed, and the user prepares the material without using the heating means according to said information.

8. A heating apparatus comprising:

(a) cooking selection keys for selecting one cooking recipe from a plurality of cooking recipes, (b) heating means for heating materials, said heating means including high frequency electric power, (c) memory means for storing a plurality of information, said plurality of information includes at least one selected from the group consisting of materials necessary for cooking, amount of the materials, preparation methods, heating methods, and treating methods after heating, (d) display means for displaying at least one of said plurality of information, said display means displaying a plurality of inputting steps and a plurality of executing steps for urging next execution to an user, (e) input means having a plurality of inputs for feeding a desired one of said plurality of information, said user inputting selectively at least one of said plurality of inputs according to an instruction displayed on said display means, and (f) control means for controlling by identifying said one information necessary for each cooking recipe, and displaying said one information at said display means, wherein after each step of said plurality of inputting steps and said plurality of executing steps, each instruction for urging next execution to said user is displayed on said display means, said display means displays the information for cooking using the heating means and the information for preparing the material without using the heating means, when the user inputs said input means according to said information, the cooking is executed, the user prepares the material without using the heating means according to said information, and the cooking is finished through said each step.

9. The heating apparatus of claim 8, wherein said plurality of input means includes at least one selected the group consisting of a cooking setting key for setting a cooking method, a cooking time key for setting a cooking time, a start key for setting a cooking start time, a display pause and restart key, and a forward and return key.

10. A cooking method comprising the steps of:

(a) heating cooking materials with a heating apparatus which includes a heating means, input means, and display means for displaying information including a plurality of inputting steps and a plurality of executing steps for urging next execution to an user, said heating means utilizing a high frequency electric power, and (b) cooking said cooking materials without said heating apparatus, wherein when the user inputs said input means according to said information, the cooking is executed, the user prepares and cooks the materials without using the heating means according to said information, and the cooking is finished through said each step.

11. A cooking method comprising the steps of:

(a) supplying a heating apparatus, said heating apparatus including heating means, memory means having a plurality of information, display means, a cooking selection key, input means having a plurality of input keys and control means, (b) supplying a plurality of cooking materials, (c) inputting said cooking selection key, in which a first information for urging next execution to a user is displayed on said display means, (d) preparing a first material of said plurality of cooking materials according to said first information displayed on said display means, and inputting a first input key when said first material is prepared, in which a second information for urging next execution to said user is displayed on said display means, (e) inputting a second input key according to said second information displayed on said display means, in which a heating is executed, and after the heating is finished, a third information for urging next execution to a user is displayed on said display means, (f) preparing a second material of said plurality of cooking materials without using said heating means, according to said third information displayed on said display means, and inputting a third input key when said second material is prepared, in which a fourth information for urging next execution to said user is displayed on said display means, (g) inputting a third input key according to said fourth information displayed on said display means, in which the heating is executed, and after the heating is finished, a fifth information for urging next execution to a user is displayed on said display means, wherein when the user inputs said input means according to said information, the cooking is executed, the user prepares the material without using the heating means according to said information, and the cooking is finished through each step.

12. The cooking method of claim 11, wherein said plurality of information include at least one selected from the group consisting of materials necessary for cooking, amount of the materials, preparation methods, heating methods, and treating methods after heating, said display means displays at least one of said plurality of information, a plurality of inputting steps and a plurality of executing steps for urging next execution to said user, said cooking selection key selects one cooking recipe from a plurality of cooking recipes, said input means having a plurality of inputs for feeding a desired one of said plurality of information, said user inputting selectively at least one of said plurality of inputs according to an instruction displayed on said display means, said control means for controlling by identifying said one information necessary for each cooking recipe, and displaying said one information at said display means, and said heating means includes high frequency electric power.

* * * * *